United States Patent [19]

Wright

[11] Patent Number: 4,640,080

[45] Date of Patent: Feb. 3, 1987

[54] PROCESS TO FORM GENERALLY RIGID CUSHION PACKAGES FROM LOOSE FILL DUNNAGE

[75] Inventor: Donald R. Wright, Midland, Mich.

[73] Assignee: The Dow Chemical Company, Midland, Mich.

[21] Appl. No.: 803,025

[22] Filed: Nov. 29, 1985

[51] Int. Cl.[4] ..... B65B 23/00

[52] U.S. Cl. ..... 53/449; 53/472; 53/474

[58] Field of Search ..... 53/472, 474, 434, 449

[56] References Cited

U.S. PATENT DOCUMENTS

| | | | |
|---|---|---|---|
| 2,897,641 | 8/1959 | Simon | 53/472 X |
| 3,222,843 | 12/1965 | Schneider . | |
| 3,238,599 | 3/1966 | Bauman | 53/434 X |
| 3,251,728 | 5/1966 | Humbert et al. . | |
| 3,307,318 | 3/1967 | Bauman | 53/472 |
| 3,412,521 | 11/1968 | Bauman | 53/472 X |
| 3,503,177 | 3/1970 | Kropscott et al. . | |
| 3,968,620 | 7/1976 | Keltner | 53/434 X |

FOREIGN PATENT DOCUMENTS

| | | | |
|---|---|---|---|
| 1064422 | 4/1967 | United Kingdom | 53/434 |

*Primary Examiner*—John Sipos

*Attorney, Agent, or Firm*—Thomas J. Mielke

[57] ABSTRACT

A process to form a generally rigid cushion package from loose fill dunnage material. The loose fill dunnage material is particles of cellular thermoplastic or thermosetting material. The process involves surrounding, within a second packaging enclosure, the article to be packaged with an amount of loose fill dunnage material. The second packaging enclosure is placed in a first packaging enclosure. The second packaging enclosure has an original volume greater than internal volume of the first packaging enclosure. An internal vacuum is created in the second packaging enclosure causing the original volume of material therein to decrease below the internal volume of the first packaging enclosure. The first packaging enclosure is sealed and the vacuum within the second packaging enclosure released.

12 Claims, 5 Drawing Figures

PROCESS TO FORM GENERALLY RIGID CUSHION PACKAGES FROM LOOSE FILL DUNNAGE

BACKGROUND OF THE INVENTION

This invention relates to a process to form generally rigid cushion packages. Specifically, it relates to a process to form generally rigid cushion packages from loose fill dunnage material.

The process of packaging articles to be shipped in loose fill dunnage material is well-known in the art. In such processes, the articles to be shipped are placed in containers and surrounded with loose fill dunnage material capable of protecting the article from damage during shipment. Any material capable of insulating the article from physical shock is suitable for use as loose fill dunnage material. One material suitable for use as loose fill dunnage material is foamed plastic material.

The use of foamed plastic material for packaging items during storage and shipment is widespread in usage. Foamed plastics have been found to provide excellent cushioning and shock absorbing properties while having a density low enough to make their usage economical.

Foamed plastic materials are generally used for packaging delicate aritcles in one of two ways: (1) the foamed plastic material may be molded or pre-shaped so as to accommodate a specific item being packaged in a specific size container, or (2) the foamed plastic material may be appear as individual particles which are placed around the article to be packaged prior to its shipment. Both of these methods present certain problems and limitations heretofore unsolved by those skilled in the art.

The method of pre-molding the foamed plastic material to accommodate a specific item suffers from a lack of flexibility. Each time a different item is to be packaged or the dimensions of the shipping container in which the item is to be packaged is changed, it becomes necessary to change the shape of the pre-molded foamed plastic material. Moreover, to be effective in cushioning the item to be packaged, the pre-molded foamed plastic material must fit snuggly around the item to be packaged as well as fitting snuggly within the shipping container. The necessity of a tight fit between the item to be packaged and the pre-molded foamed plastic material as well as the shipping container and the pre-molded foamed plastic material leads to a more involved and therefore, slower packaging process.

The use of a pre-molded foamed packaging material has the advantage of providing effective cushioning with little or no chance of the contents of the shipping container shifting and thereby allowing the packaged item to contact the walls of the shipping container. Additionally, the snug fit between the shipping container and the pre-molded foamed plastic provides an additional degree of rigidity to the shipping container. This added rigidity serves to better protect the packaged article.

The method of surrounding the item to be packaged with individual particles of foamed plastic materials is problematic in that the individual particles of foamed plastic material have a tendancy to shift or settle during shipment thereby allowing the packaged item to contact the walls of the shipping container, said contact often resulting in damage to the packaged item. Additionally, the individual particles of foamed plastic material provide no additional support to the shipping container thereby increasing the likelihood of damage to the packaged item during shipping through rough handling of the shipping container.

The method of packaging wherein the item to be packaged is surrounded by individual particles of foamed plastic materials possesses the advantage of being extremely flexible. The individual particles of foamed plastic material are suitable for packaging almost any shaped article in widely divergent shipping containers. Additionally, since the individual particles of foamed plastic material are merely poured into the shipping container to surround the item to be packaged the process of packaging is quick and efficient.

It would be desirable to develop a process of packaging which overcomes the disadvantages associated with the above described processes of packaging while retaining the advantages. It is to this goal that the present invention is directed.

SUMMARY OF THE INVENTION

The present invention concerns a process to form a generally rigid package from loose fill dunnage material, the steps of the process comprising:

(a) providing a first packaging enclosure capable of being sealed and withstanding a degree of internal pressure without substantial expansion;

(b) providing a generally flexible, easily deformable second packaging enclosure having an internal volume greater than that of the first packaging enclosure, said second packaging enclosure being capable of being sealed and maintaining an internal vacuum for a length of time sufficient to complete the process steps, set forth below, requiring an internal vacuum in the second packaging enclosure;

(c) placing the second packaging enclosure within the first packaging enclosure;

(d) placing the article to be packaged within the second packaging enclosure;

(e) filling the second packaging enclosure with an amount of resilient loose fill dunnage material, the amount of resilient loose fill dunnage material, having an original volume greater than the internal volume of the first packaging enclosure;

(f) sealing the second packaging enclosure;

(g) creating an internal vacuum within the second packaging enclosure, said internal vacuum being sufficient to cause the original volume of the resilient loose fill dunnage material to decrease below the internal volume of the first packaging enclosure;

(h) sealing the first packaging enclosure; and (i) releasing the vacuum within the second packaging enclosure thus allowing the resilient loose fill dunnage material to increase in volume until being substantially equal to the volume of the first packaging enclosure.

Additionally, the invention relates to a package formed by the above described process.

DETAILED DESCRIPTION OF THE INVENTION

Figure 1:
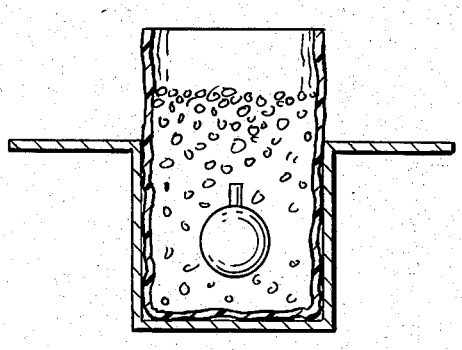
FIG. 1 represents a cross-sectional view of a first packaging enclosure having disposed therein a second packaging enclosure. The second packaging enclosure has an article to be packaged disposed therein, the article is surrounded with an amount of resilient loose fill dunnage material. The combined volume of the article to be packaged and the resilient loose fill dunnage material is greater than the internal volume of the first packaging enclosure.

A wide variety of materials are suitable for use in forming the first packaging enclosure. The first packaging enclosure will generally be semi-rigid. Suitable materials from which to form the first packaging enclosure include cardboard, wood, sheet metal, and plastic. The first packaging enclosure must be capable of being sealed to define an internal area having a desired volume. Additionally, the first packaging enclosure must be able to withstand a degree of internal pressure without substantial expansion. Generally, the internal pressure exerted on the first packaging enclosure will be in a range from about 0 to about 10 pounds per square inch, preferably from about 0 to about 5 pounds per square inch. It is generally desirable that the first packaging enclosure be capable of withstanding said internal pressure without a significant degree of expansion.

A second packaging enclosure is provided. For the purpose of this application, the phrase "second packaging enclosure" is intended to encompass a single second packaging enclosure as well as two or more second packaging enclosures.

The second packaging enclosure is generally flexible and easily deformable. The second packaging enclosure is generally formed from a film of a polymeric resin. Any polymeric resin capable of forming a film, and which is capable of meeting the additional requirements of the second packaging enclosure set forth below, is suitable for use in forming the second packaging enclosure. Exemplary of such films are the olefin homopolymers, olefin interpolymers, copolymers of vinylidene chloride, and copolymers of vinylchloride. Beneficially, the second packaging enclosure is formed from a polymeric resin selected from the group consisting of polyvinylchloride, polyethylene, polypropylene, polybutylene, and vinylidene chloride copolymers. When the second packaging enclosure is formed from a vinylidene chloride copolymer, the vinylidene chloride copolymer generally comprises vinylidene chloride in an amount of from about 50 to about 98 weight percent based on total weight of the vinylidene chloride copolymer. The preferred polymeric resin for forming the second packaging enclosure is polyethylene.

In addition to being generally flexible and easily deformable, the second packaging enclosure must be capable of being sealed. Any method of sealing capable of meeting the requirement set forth below of maintaining an internal vacuum is suitable for use in the present invention. Exemplary of such sealing techniques are tieing, clipping, and heat sealing.

Finally, the second packaging enclosure must be capable of maintaining an internal vacuum for a length of time sufficient to complete the process steps requiring an internal vacuum in the second packaging enclosure. For this reason, it is necessary that the second packaging enclosure possess a degree of impermeability to atmospheric gases.

In one embodiment of the present invention wherein a single second packaging enclosure is employed, it is necessary that the second packaging enclosure have a volume greater than that of the first packaging enclosure.

The second packaging enclosure is placed within the first packaging enclosure. The article to be packaged is placed within the second packaging enclosure and surrounded with an amount of resilient loose fill dunnage material. See FIG. 1. The loose fill dunnage material is added to the second packaging enclosure in an amount such that the original volume thereof is greater than the internal volume of the first packaging enclosure. For the purposes of this application, the term "original volume" refers to the volume of the resilient loose fill dunnage material, including any gases occluded therein, plus the volume of interstitial area between the particles of resilient loose fill dunnage material under ambient pressure conditions.

The resilient loose fill dunnage material suitable for use in the present invention comprises particles of cellular thermoplastic or thermosetting material. The cellular material is made by foaming thermoplastic or thermosetting resins. Methods of forming cellular material are well-known in the prior art. Any of the known methods for forming cellular material are suitable for use in the present invention. Exemplary of such methods are U.S. Pat. Nos. 3,047,136; 3,066,382; 3,188,264; 3,251,728; 3,400,037; 3,481,455; 3,723,237; and 3,723,240; the teachings of which are incorporated herein by reference.

Suitable thermoplastic or thermosetting materials for use in the present invention include thermoplastic or thermosetting resins which are capable of forming cellular foams. Desirable thermoplastic or thermosetting materials for use in the present invention include the resinous alkenyl aromatic polymers, the resinous aliphatic olefin polymers, and the urethanes.

The resinous alkenyl aromatic polymers normally comprise, in chemically combined form, at least about 50 percent by weight of at least one alkenyl aromatic compound having the general formula:

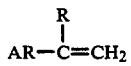

wherein "AR" represents an aromatic hydrocarbon or a nuclear halo hydrocarbon radical of the benzene series, and "R" is hydrogen or the methyl radical. Examples of such alkenyl aromatic polymers are homopolymers of styrene, alpha-methyl styrene, ortho-, meta-, and para-methyl styrene, ar-ethylstyrene, and ar-chlorostyrene; the copolymers of two or more such alkenyl aromatic compounds with one another; and copolymers of one or more of such alkenyl aromatic compounds with minor amounts of other readily polymerizable ethylenically unsaturated compounds such as divinyl benzene, methyl methacrylate, acrylonitrile, etc. The preferred alkenyl aromatic polymer is a homopolymer of styrene.

Resinous aliphatic olefin polymers beneficial for use in the present invention are the homopolymers or interpolymers of alpha-monoolefinic aliphatic hydrocarbons containing from 2 to 8 carbon atoms, such as ethylene, propylene, butene-1, pentene-1, 3-methylbutene-1, 4-methylpentene-1, 4-methylhexene-1, or 5-methylhexene-1. Interpolymers of the above alpha-monoolefinic aromatic hydrocarbons can be formed by polymerizing two or more of the above listed alpha-monoolefinic aliphatic hydrocarbons, or by polymerizing at least one of the above listed alpha-monoolefinic aliphatic hydrocarbons with one or more monomers copolymerizable therewith. Examples of suitable copolymerizable compounds are vinylacetate; $C_1$–$C_4$ alkyl acrylates, such as ethyl-acrylate; styrene; lower alkyl esters of methacrylic acid, such as methyl methacrylate; tetrafluoroethylene; and acrylonitrile. The preferred aliphatic olefin polymers are homopolymers of ethylene or propylene or interpolymers of ethylene and/or propylene. The preferred interpolymers of ethylene or propylene comprise at least about 75 weight percent of ethylene or propylene with not more than 25 percent of one or more of the above listed copolymerizable compounds. The aliphatic olefin polymers can be modified by blending with polymeric materials, e.g., polyisobutylene, acrylonitrile-butadiene rubbers, poly(2-butadiene-1,3), polyisoprene or ethylene-vinylacetate copolymers. Halogenated aliphatic olefin polymers may also be used.

Typically, the urethanes which can be used in the practice of the present invention are produced by the reaction of a polyisocyanate with a polyfunctional compound having an active hydrogen in its structure. Most commonly, the active hydrogen compound contains hydroxyl groups as the moieties having the active hydrogen and are thus termed polyols.

Exemplary of polyols suitable for use in the present invention are the polyol polyethers, the polyol polyesters, hydroxy functional acrylic polymers, hydroxyl-containing epoxy resins, polyhydroxy terminated polyurethane polymers, polyhydroxyl-containing phosphorus compounds, and alkylene oxide adducts of polyhydric thioethers including polythioethers, acetals including polyacetals, aliphatic and aromatic polyols and thiols including polythiols, ammonia and amines including aromatic, aliphatic and heterocyclic amines including polyamines as well as mixtures thereof.

The polyisocyanates useful in this invention include organic diisocyanates, for example, aliphatic diisocyanates, cycloaliphatic diisocyanates, or aromatic diisocyanates; or organic polyisocyanates, for example, aliphatic polyisocynates, cycloaliphatic polyisocyanate, or aromatic polyisocyanates.

Exemplary of the diisocyanates suitable for use in the present invention are m-phenylene diisocyanate, tolylene-2,4-diisocyanate, tolylene-2,6-diisocyanate, hexamethylene-1,6,diisocyanate, tetramethylene-1,4-diisocyanate, cyclohexane-1,4-diisocyanate, hexahydrotolylene diisocyanate (and isomers), naphthylene-1,5-diisocyanate, 1-methoxyphenyl-2,4-diisocyanate, diphenylmethane-4,4-diisocyanate, 4,4'-biphenylene diisocyanate, 3,3-dimethyl-4,4'biphenyl diisocyanate, and 3,3'-dimethyldiphenylmethane-4,4'-diisocyanate.

The polyurethanes suitable for use are prepared by methods well-known to those skilled in the art for the preparation of polyurethanes. Such methods are described in *Polyurethanes: Chemistry and Technology I. Chemistry,* Saunders and Frisch, Interscience (1962), incorporated herein by reference.

Figure 2:
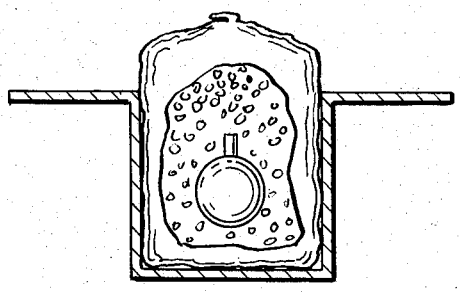
FIG. 2 represents a cross-sectional view of the structure of FIG. 1 after the second packaging enclosure has been sealed.

After the addition of the resilient loose fill dunnage material, the second packaging enclosure is sealed. See FIG. 2. Any method of sealing the second packaging enclosure is suitable for use in the present invention as long as the seal is capable of maintaining an internal vacuum within the second packaging enclosure for a length of time sufficient to complete the process steps of the present invention which requires an internal vacuum in the second packaging enclosure. Exemplary of such sealing methods are tieing, clipping, and heat sealing.

Figure 3:
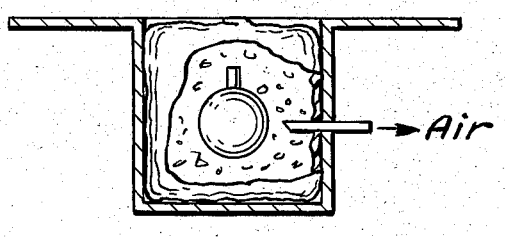
FIG. 3 represents a cross-sectional view of the structure of FIG. 2 after an internal vacuum has been created in the second packaging enclosure. The internal vacuum is sufficient to cause the combined volume of the article to be packaged and the resilient loose fill dunnage material to decrease below the internal volume of the first packaging enclosure.

After sealing the second packaging enclosure, an internal vacuum is created within the second packaging enclosure. The internal vacuum created within the second packaging enclosure must be sufficient to cause the original volume of the resilient loose fill dunnage material to decrease below the internal volume of the first packaging enclosure. See FIG. 3. Any method of creating an internal vacuum within the second packaging enclosure is suitable for use in the present invention as long as it does not destroy the cellular integrity of the resilient loose fill dunnage material. A preferred method of creating the internal vacuum within the second packaging enclosure is to insert a hollow tube or needle into the second packaging enclosure and withdraw a portion of the atmospheric gases present in the interstitial spaces between the particles of the loose fill dunnage material as well as a portion of the gas occluded within the loose fill dunnage material.

Creation of the internal vacuum within the second packaging enclosure causes the atmospheric pressure to compact the particles of loose fill dunnage material present in the second packaging enclosure. The internal vacuum created within the second packaging enclosure must be of sufficient magnitude to decrease the original volume of the loose fill dunnage material present in the second packaging enclosure to from about 90 to about 40 percent of its original volume. That is, the internal vacuum created within the second packaging enclosure must be sufficient to cause a compaction of the loose fill dunnage material present within the second packaging enclosure of from about 10 to about 60 percent of its original volume. Preferably, the internal vacuum created within the second packaging enclosure is sufficient to cause the loose fill dunnage material present in the second packaging enclosure to decrease to from about 90 to about 70 percent of its original volume.

The thermoplastic or thermosetting material can be formed into either open-celled or close-celled foam. In one preferred embodiment of the present invention the open-celled foam has been found to be desriable since it is easier to reduce the original volume of such foam by creating the internal vacuum within the second packaging enclosure. This is because the gas occluded within the open-celled foam is more easily removed than the gas occluded within the close-celled foam.

Figure 4:
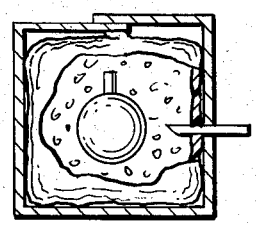
FIG. 4 represents a cross-sectional view of the structure of FIG. 3 after the first packaging enclosure has been sealed.

After the creation of the internal vacuum in the second packaging enclosure causes the original volume of the resilient loose fill dunnage material to decrease below the internal volume of the first packaging enclosure, the first packaging enclosure is sealed. See FIG. 4. Suitable methods of sealing the first packaging enclosure are well-known in the art. Examples of such methods include, taping, stapling, gluing etc.

Figure 5:
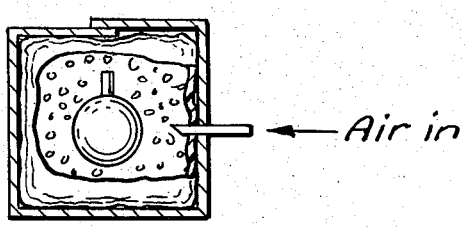
FIG. 5 represents a cross-sectional view of the structure of FIG. 4 after the internal vacuum within the second packaging enclosure has been released, thus allowing the resilient loose fill dunnage material to expand until restrained by the first packaging enclosure.

After the first packaging enclosure has been sealed the internal vacuum within the second packaging enclosure is released. In the embodiment of the present invention wherein the internal vacuum within the second packaging enclosure is created by inserting a hollow tube or needle therein and withdrawing atmospheric gas, the vacuum is easily and economically released by allowing the atmospheric gas removed from within the second packaging enclosure to reenter through the hollow tube or needle. See FIG. 5. Alternatively, though less desirable, the atmospheric gases may be allowed to reenter the second packaging enclosure by diffusing through the film of polymeric resins which forms the second packaging enclosure.

The release of the internal vacuum within the second packaging enclosure allows the equalization of pressure within the second packaging enclosure with ambient atmospheric pressure. This equalization of pressure allows the resilient loose fill dunnage material to expand until restrained by the first packaging enclosure. Because the internal volume of the first packaging enclosure is less than the original volume of the loose fill dunnage material present therein, the second packaging enclosure cannot reexpand to its original volume. By thus limiting the amount of expansion which can occur, an internal pressure is created within the first packaging enclosure which provides rigidity to the first packaging enclosure as well as restraining the packaged article and individual particles of loose fill dunnage material from shifting or otherwise migrating during shipment.

In another embodiment of the present invention, a first packaging enclosure, as described above, is provided. Two or more generally flexible, easily deformable second packaging enclosures are also provided. The second packaging enclosures must be capable of being sealed and maintaining an internal vacuum for a length of time sufficient to complete the process steps, set forth below, requiring an internal vacuum in the second packaging enclosures. However, the second packaging enclosure need not have an individual internal, volume greater than that of the first packaging enclosure. The second packaging enclosures are comprised of the same material suitable for use in the embodiment of the present invention set forth above. Additionally, the methods of sealing the second packaging enclosures are the same as set forth above.

The second packaging enclosures are filled to a desirable level with loose fill dunnage material. The loose fill dunnage material is the cellular thermoplastic or thermosetting material hereinbefore described. The amount of loose fill dunnage material added to the individual second packaging enclosures is chosen dependant on the item to be packaged. The only requirement being that the original volume of the loose fill dunnage material present in the second packaging enclosures which are to be placed in the first packaging enclosure when taken in conjunction with the volume of the article to be packaged and the inter-stitial spaces present in the first packaging enclosure between the second packaging enclosures the item to be packaged, and the first packaging enclosure, is greater than the internal volume of the first packaging enclosure.

The second packaging enclosures are then sealed. Again, methods suitable for sealing the second packaging enclosures are well-known in the prior art. Exemplary of such known methods are tieing, clipping, and heat sealing. The sealed second packaging enclosures must be capable of maintaining an internal vacuum in the second packaging enclosures for a length of time sufficient to complete the processing steps set forth below, which require an internal vacuum in the second packaging enclosures.

The article to be packaged is placed in the first packaging container and surrounded with two or more of the second packaging enclosures. The number of second packaging enclosures used to surround the article to be packaged is to some extent dependant on the degree of protection required during shipment, the size and con-figuration of the article to be packaged, the size and configuration of the first packaging enclosure, and other similar considerations.

An internal vacuum is then created in at least one of the second packaging enclosures, preferably in all of the second packaging enclosures. Methods of creating said internal vacuum are the same as those hereinbefore set forth. The internal vacuum created within the second packaging enclosures is of sufficient magnitude to cause the original volume of the resilient loose fill dunnage material present in the second packaging enclosures, to decrease to a point such that the volume of the second packaging enclosures, articles to be packaged, and the interstitial spaces between the second packaging enclosures, the article to be packaged, and the structure defining the first packaging enclosure is less than the internal volume of the first packaging enclosure. Generally, the original volume of the loose fill dunnage material present in the second packaging enclosures is reduced to from about 90 to about 40 percent of its original volume. That is, the original volume of the loose fill dunnage material present in the second packaging enclosures is decreased from about 10 to about 60 percent. Preferably, the original volume of the loose fill dunnage material present in the second packaging enclosures is decreased to from about 90 to about 70 percent of its original volume.

The first packaging enclosure is then sealed. Methods of sealing the first packaging enclosures are well-known in the prior art. Exemplary of such methods are taping, stapling, gluing, etc.

The internal vacuum present in the second packaging enclosures is then released. Methods of releasing the internal vacuum present in the second packaging enclosure are the same as those hereinbefore set forth. The release of the internal vacuum present in the second packaging enclosures allows the particles of loose fill dunnage material to expand until restricted by the first packaging enclosure. Since the loose fill dunnage material present in the first packaging enclosure is unable to expand to its original volume due to restriction by the first packaging enclosure, an internal pressure is created within the first packaging enclosure. This internal pressure adds to the strength of the first packaging enclosure as well as preventing the packaged article from moving about within the first enclosure.

The following examples are meant to be illustrative only and are not intended to limit, in any manner, the scope of the invention as set forth in the claims.

EXAMPLE 1

A first packaging enclosure was provided. The first packaging enclosure was a cardboard box having inside measurements of 12×11×9.5 inches. A second packaging enclosure was provided. The second packaging enclosure was a polyethylene bag having an internal volume greater than the internal volume of the first packaging enclosure. The second packaging enclosure was placed inside the first packaging enclosure.

Into the second packaging enclosure was placed an amount of PELASPAN-PAC* expanded polystyrene cushioning material commercially available from The Dow Chemical Company. The amount of polystyrene cushioning material added to the second packaging enclosure had an original volume 25 percent greater than the internal volume of the first packaging enclosure. The second packaging enclosure was sealed. A hollow tube was inserted through the side of the first packaging enclosure and into the second packaging enclosure. The hollow tube was connected to a suction pump and a vacuum was drawn. Air was removed from the interior of the second pack-aging enclosure until the polystyrene cushioning material had decreased in volume sufficiently for the lid of the first packaging enclosure to be sealed.

*Trademark of The Dow Chemical Company

The first packaging enclosure was sealed and the internal vacuum within the second packaging enclosure released by allowing air to enter the second packaging enclosure through the hollow tube inserted therein. The expansion of the polystyrene cushioning material was restricted by the first packaging enclosure, said restricted expansion providing an internal pressure within the first packaging enclosure of approximately 0.5 psi. For the purposes of this example, no article was packaged within the first or second packaging enclosure.

EXAMPLES 2–3

The described procedure is followed to produce both examples 2 and 3 with the only difference being the amount of vacuum drawn within the second packaging enclosure.

A first packaging enclosure is provided. The first packaging enclosure is a cardboard box having inside measurements of 12×11×9.5 inches. A second packaging enclosure is provided. The second packaging enclosure is a polyethylene bag having an internal volume greater than the internal volume of the first packaging enclosure. The second packaging enclosure is placed inside the first packaging enclosure.

An amount of open celled polyurethane foam having a density of 2 pounds per cubic foot is placed within the second packaging enclosure. The amount of polyurethane foam placed within the second packaging enclosure has a volume greater than the volume of the first packaging enclosure. The second packaging enclosure is sealed. A hollow tube is inserted through the side of the first packaging enclosure and into second packaging enclosure. The hollow tube is connected to a suction pump and a vacuum is drawn.

For example 2 a vacuum of 10 millimeters of mercury is drawn and found to reduce the volume of the polyurethane foam to 16.3 percent of its original volume. For example 3 a vacuum of 100 millimeters of mercury is drawn and found to reduce the volume of the polyurethane foam to 27.2 percent of its original volume.

The first packaging enclosure is sealed. After sealing, the vacuum within the second packaging enclosure is released by allowing air to enter the second packaging enclosure through the hollow tube inserted therein. The polyurethane foam expands on release of the vacuum until restrained by the first packaging enclosure. For the purposes of these examples, no article is packaged within the first or second packaging enclosure.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or other-wise limiting of the present invention, excepting as it is set forth and defined in the following claims.

What is claimed is:

1. A process to form a generally rigid package from loose fill dunnage, the steps of the process comprising:

(a) providing a first packaging enclosure capable of being sealed and withstanding a degree of internal pressure without substantial expansion;

(b) providing a generally flexible, easily deformable second packaging enclosure having an internal volume greater than that of the first packaging enclosure, said second packaging enclosure being capable of being sealed and maintaining an internal vacuum for a length of time sufficient to complete the process steps, set forth below, requiring an internal vacuum in the second packaging enclosure;

(c) placing the second packaging enclosure within the first packaging enclosure;

(d) placing the article to be packaged within the second packaging enclosure;

(e) filling the second packaging enclosure with an amount of resilient loose fill dunnage material, the amount of resilient loose fill dunnage material having an original volume greater than the internal volume of the first packaging enclosure;

(f) sealing the second packaging enclosure;

(g) creating an internal vacuum within the second packaging enclosure, said internal vacuum being sufficient to cause the original volume of the resilient loose fill dunnage material to decrease below the internal volume of the first packaging enclosure;

(h) sealing the first packaging enclosure; and (i) releasing the vacuum within the second packaging enclosure thus allowing the resilient loose fill dunnage material to increase in volume until being substantially equal to the volume of the first packaging enclosure.

2. The process of claim 1 wherein the first packaging enclosure comprises cardboard, wood, sheet metal, or plastic.

3. The process of claim 1 wherein the second packaging enclosure is a bag formed from a polymeric resin.

4. The process of claim 3 wherein the polymeric resin is selected from the group consisting of olefin homopolymers, olefin copolymers, copolymers of vinylidene chloride and copolymers of vinyl chloride.

5. The process of claim 1 wherein the resilient loose fill dunnage comprises particles of cellular thermoplastic or thermosetting material.

6. The process of claim 5 wherein the cellular thermoplastic or thermosetting material is foamed polystyrene.

7. The process of claim 5 wherein the cellular thermoplastic or thermosetting material is foamed polyurethane.

8. The process of claim 1 wherein the resilient loose fill dunnage has an original volume of from about 10 to about 60 percent greater than the volume of the first packaging enclosure.

9. The process of claim 8 wherein the resilient loose fill dunnage has an original volume from about 10 to about 30 percent greater than the volume of the first packaging enclosure.

10. The process of claim 1 wherein an internal vacuum is created in the second packaging enclosure by inserting a hollow tube into the second packaging enclosure and withdrawing air from the interior of the second packaging enclosure through the hollow tube.

11. The process of claim 1 wherein the original volume of the resilient loose fill dunnage is decreased by about 10 to about 60 percent of its original volume.

12. The process of claim 11 wherein the original volume of the resilient loose fill dunnage is decreased by about 10 to about 30 percent of its original volume.

* * * * *